US010837689B2

(12) United States Patent
Bertolini et al.

(10) Patent No.: US 10,837,689 B2
(45) **Date of Patent: *Nov. 17, 2020**

(54) ICE MAKER WITH ROTATING ICE TRAY

(71) Applicant: Electrolux Home Products, Inc., Charlotte, NC (US)

(72) Inventors: Nilton Carlos Bertolini, Anderson, SC (US); Zhuochen Shi, Anderson, SC (US); Thomas McCollough, Anderson, SC (US); Jorge Montalvo, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/397,000

(22) Filed: Apr. 29, 2019

(65) Prior Publication Data

US 2019/0249914 A1 Aug. 15, 2019

Related U.S. Application Data

(63) Continuation of application No. 15/983,366, filed on May 18, 2018, now Pat. No. 10,323,872, which is a (Continued)

(51) Int. Cl.

| | |
|---|---|
| ***F25C 5/08*** | (2006.01) |
| ***F25C 5/20*** | (2018.01) |
| ***F25D 21/14*** | (2006.01) |

(52) U.S. Cl.

CPC ..... *F25C 5/08* (2013.01); *F25C 5/22* (2018.01); *F25D 21/14* (2013.01); *F25C 2305/022* (2013.01)

(58) Field of Classification Search

CPC ..... F25C 1/10; F25C 5/08; F25C 5/22; F25C 2305/022

See application file for complete search history.

(56) References Cited

U.S. PATENT DOCUMENTS

| | | | |
|---|---|---|---|
| 2,403,406 | A | 9/1944 | Smith |
| 2,846,854 | A | 8/1958 | Galin |

(Continued)

OTHER PUBLICATIONS

International Search Report for PCT/US2017/0120707, dated Jun. 6, 2017.

*Primary Examiner* — Cassey D Bauer
(74) *Attorney, Agent, or Firm* — Pearne & Gordon LLP

(57) ABSTRACT

A refrigeration appliance includes a fresh food compartment and a freezer compartment. An ice maker with an ice mold is disposed within the fresh food compartment for freezing water into ice pieces. A refrigeration system includes a system evaporator and an ice maker evaporator dedicated to cooling the ice mold. A frame rotatably supports the ice mold within the fresh food compartment between an ice-forming position and an ice-harvesting position. The frame supports the ice maker evaporator at a stationary position that serves as a pivot axis for the ice mold so the ice mold can rotate around the ice maker evaporator between the ice-forming position and the ice-harvesting position, while the ice maker evaporator remains stationary. In one example, a heater is rotatable with the ice mold, and a drip tray is located underneath ice mold and rotatable with the ice mold.

19 Claims, 7 Drawing Sheets

Related U.S. Application Data continuation of application No. 14/989,014, filed on Jan. 6, 2016, now Pat. No. 9,976,788.

(56) References Cited

U.S. PATENT DOCUMENTS

| | | | |
|---|---|---|---|
| 2,941,379 | A | 6/1960 | Nelson |
| 3,192,726 | A | 5/1964 | Newton |
| 3,788,089 | A | 1/1974 | Graves |
| 8,104,297 | B2 | 1/2012 | Heger et al. |
| 8,181,471 | B2 | 5/2012 | Heger et al. |
| 8,484,987 | B2 | 7/2013 | Ducharme et al. |
| 8,511,106 | B2 | 8/2013 | Ducharme et al. |
| 8,578,721 | B2 | 11/2013 | McCollough et al. |
| 8,584,474 | B2 | 11/2013 | McCollough et al. |
| 8,601,829 | B2 | 12/2013 | Heger et al. |
| 8,616,018 | B2 | 12/2013 | Jeong et al. |
| 8,776,544 | B2 | 7/2014 | McCollough et al. |
| 8,875,536 | B2 | 11/2014 | Jeong et al. |
| 8,950,197 | B2 | 2/2015 | Bortoletto et al. |
| 8,973,391 | B2 | 3/2015 | Lee |
| 8,973,392 | B2 | 3/2015 | Jeong et al. |
| 8,978,406 | B2 | 3/2015 | Candeo |
| 9,074,804 | B2 | 7/2015 | Yoon |
| 9,080,799 | B2 * | 7/2015 | Hong ..... F25C 5/182 |
| 9,109,829 | B2 | 8/2015 | Lim et al. |
| 2009/0044559 | A1 | 2/2009 | Heger |
| 2009/0113918 | A1 | 5/2009 | Heger |
| 2009/0193824 | A1 | 8/2009 | Heger |
| 2009/0272141 | A1 | 11/2009 | Heger |
| 2009/0277191 | A1 | 11/2009 | Heger |
| 2010/0011786 | A1 | 1/2010 | Shin |
| 2010/0139295 | A1 | 6/2010 | Zuccolo |
| 2010/0326118 | A1 | 12/2010 | Jeong et al. |
| 2011/0000248 | A1 | 1/2011 | Jeong et al. |
| 2011/0162404 | A1 | 7/2011 | Shin et al. |
| 2011/0162406 | A1 | 7/2011 | Shin et al. |
| 2012/0042681 | A1 | 2/2012 | McDaniel |
| 2012/0279240 | A1 | 11/2012 | Jeong et al. |
| 2012/0318003 | A1 | 12/2012 | Kim |
| 2013/0227983 | A1 | 9/2013 | Jeong et al. |
| 2013/0263621 | A1 | 10/2013 | An et al. |
| 2013/0264929 | A1 | 10/2013 | An et al. |
| 2013/0298405 | A1 | 11/2013 | An et al. |
| 2014/0165602 | A1 | 6/2014 | Whirlpool |
| 2015/0013374 | A1 | 1/2015 | Jeong et al. |
| 2015/0135760 | A1 | 5/2015 | Jeong et al. |
| 2015/0323238 | A1 | 11/2015 | Lim et al. |

* cited by examiner

ICE MAKER WITH ROTATING ICE TRAY

CROSS-REFERENCE TO RELATED APPLICATIONS

This application is a continuation of U.S. application Ser. No. 15/983,366 filed on May 18, 2018, which is a continuation of U.S. application Ser. No. 14/989,014 filed on Jan. 6, 2016. These applications are incorporated herein by reference.

FIELD OF THE INVENTION

This application relates generally to an ice maker for a refrigeration appliance, and more particularly, to a refrigeration appliance including an ice maker disposed within a food-storage compartment of a refrigerator that is maintained at a temperature above a freezing temperature of water at atmospheric conditions.

BACKGROUND OF THE INVENTION

Conventional refrigeration appliances, such as domestic refrigerators, typically have both a fresh food compartment and a freezer compartment or section. The fresh food compartment is where food items such as fruits, vegetables, and beverages are stored and the freezer compartment is where food items that are to be kept in a frozen condition are stored. The refrigerators are provided with a refrigeration system that maintains the fresh food compartment at temperatures above 0° C. and the freezer compartments at temperatures below 0° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment may be accessed without exposing the other compartment to the ambient air.

Such conventional refrigerators are often provided with a unit for making ice pieces, commonly referred to as "ice cubes" despite the non-cubical shape of many such ice pieces. These ice making units normally are located in the freezer compartments of the refrigerators and manufacture ice by convection, i.e., by circulating cold air over water in an ice tray to freeze the water into ice cubes. Storage bins for storing the frozen ice pieces are also often provided adjacent to the ice making units. The ice pieces can be dispensed from the storage bins through a dispensing port in the door that closes the freezer to the ambient air. The dispensing of the ice usually occurs by means of an ice delivery mechanism that extends between the storage bin and the dispensing port in the freezer compartment door.

However, for refrigerators such as the so-called "bottom mount" refrigerator, which includes a freezer compartment disposed vertically beneath a fresh food compartment, placing the ice maker within the freezer compartment is impractical. Users would be required to retrieve frozen ice pieces from a location close to the floor on which the refrigerator is resting. And providing an ice dispenser located at a convenient height, such as on an access door to the fresh food compartment, would require an elaborate conveyor system to transport frozen ice pieces from the freezer compartment to the dispenser on the access door to the fresh food compartment. Thus, ice makers are commonly included in the fresh food compartment of bottom mount refrigerators, which creates many challenges in making and storing ice within a compartment that is typically maintained above the freezing temperature of water. Operation of such ice makers may be affected by temperature fluctuations and other events occurring within the fresh food compartments housing the ice makers, and prolonged exposure of the ice to the ambient environment of the fresh food compartment can result in partial melting of ice pieces. Further, assembly of such refrigerators can be complex and labor intensive due in part to the measures that must be taken to store ice pieces within the fresh food compartment.

BRIEF SUMMARY OF THE INVENTION

The following presents a simplified summary of example embodiments of the invention. This summary is not intended to identify critical elements of the invention or to delineate the scope of the invention. The sole purpose of the summary is to present some example embodiments in simplified form as a prelude to the more detailed description that is presented later.

In accordance with one aspect, a refrigeration appliance is provided, comprising a fresh food compartment for storing food items in a refrigerated environment having a target temperature above zero degrees Centigrade. A freezer compartment stores food items in a sub-freezing environment having a target temperature below zero degrees Centigrade. An ice maker is disposed within the fresh food compartment for freezing water into ice pieces, the ice maker comprising an ice mold with a plurality of cavities for the ice pieces. A frame extends from a first end of the ice mold to a second end of the ice mold, the frame rotatably supporting the ice mold within the fresh food compartment between an ice-forming position and an ice-harvesting position. A refrigeration system comprises a system evaporator for providing a cooling effect to at least one of the fresh food and freezer compartments, and an ice maker evaporator disposed adjacent the ice mold and dedicated to cooling the ice mold to a temperature below zero degrees Centigrade. The frame supports the ice maker evaporator at a stationary position that serves as a pivot axis for the first end of the ice mold so that the ice mold can rotate around the ice maker evaporator between the ice-forming position and the ice-harvesting position, while the ice maker evaporator remains stationary.

In accordance with another aspect, a refrigeration appliance comprises a fresh food compartment for storing food items in a refrigerated environment having a target temperature above zero degrees Centigrade. A freezer compartment stores food items in a sub-freezing environment having a target temperature below zero degrees Centigrade. An ice maker is disposed within the fresh food compartment for freezing water into ice pieces, the ice maker comprising an ice mold with a plurality of cavities for the ice pieces. The ice mold is rotatably supported within the fresh food compartment between an ice-forming position and an ice-harvesting position. A refrigeration system comprises a system evaporator for providing a cooling effect to at least one of the fresh food and freezer compartments, and an ice maker evaporator in contact with the ice mold and dedicated to cooling the ice mold to a temperature below zero degrees Centigrade. A heater is rotatable with the ice mold and operable to provide a heating effect to the ice mold to thereby separate congealed ice pieces from the ice mold during an ice harvesting operation. A drip tray is located underneath ice mold and rotatable with the ice mold. The drip tray extends between a first end and a second end of the ice mold to collect water droplets created when the heater is operated.

It is to be understood that both the foregoing general description and the following detailed description present example and explanatory embodiments. The accompanying drawings are included to provide a further understanding of the described embodiments and are incorporated into and constitute a part of this specification. The drawings illustrate various example embodiments.

BRIEF DESCRIPTION OF THE DRAWINGS

The foregoing and other aspects of the present invention will become apparent to those skilled in the art to which the present invention relates upon reading the following description with reference to the accompanying drawings, in which.

DESCRIPTION OF EXAMPLE EMBODIMENTS

Figure 1:
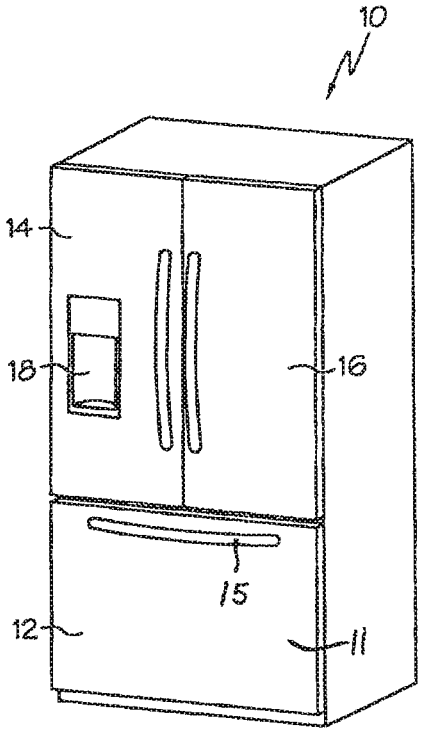
FIG. 1 illustrates a perspective view of an embodiment of a refrigerator including an ice maker disposed in a fresh food compartment.

Example embodiments are described and illustrated in the drawings. These illustrated examples are not intended to be a limitation on the present invention. For example, one or more aspects can be utilized in other embodiments and even other types of devices. Moreover, certain terminology is used herein for convenience only and is not to be taken as a limitation. Still further, in the drawings, the same reference numerals are employed for designating the same elements.

Figure 2:
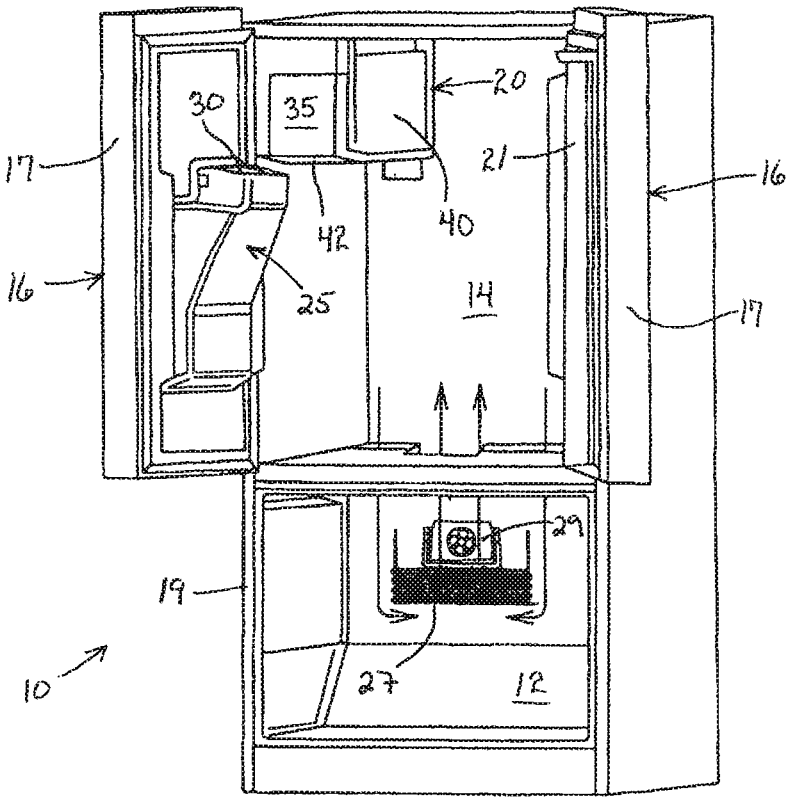
FIG. 2 illustrates a perspective view of an embodiment of a refrigerator including an ice maker disposed in a fresh food compartment with French doors providing access into the fresh food compartment.

Turning to the shown example of FIG. 1, there is illustrated a refrigeration appliance in the form of a domestic refrigerator, indicated generally at 10. Although the detailed description that follows concerns a domestic refrigerator 10, the invention can be embodied by refrigeration appliances other than with a domestic refrigerator 10. Further, an embodiment is described in detail below, and shown in the figures as a bottom-mount configuration of a refrigerator 10, including a fresh-food compartment 14 disposed vertically above a freezer compartment 12. However, the refrigerator 10 can have any desired configuration including at least a fresh food compartment 14 and an ice maker 20 (FIG. 2). Various examples of such a domestic refrigerator are disclosed in co-assigned U.S. Pat. No. 7,681,406, filed on Jan. 13, 2006, and U.S. Pat. No. 8,511,106, filed on Feb. 26, 2010, both of which are incorporated in their entirety herein by reference.

One or more doors 16 shown in FIG. 1 are pivotally coupled to a cabinet 19 of the refrigerator 10 to restrict and grant access to the fresh food compartment 14. The door 16 can include a single door that spans the entire lateral distance across the entrance to the fresh food compartment 14, or can include a pair of French-type doors 16 as shown in FIG. 1 that collectively span the entire lateral distance of the entrance to the fresh food compartment 14 to enclose the fresh food compartment 14. For the latter configuration, a flipper mullion 21 (FIG. 2) is pivotally coupled to at least one of the doors 16 to establish a surface against which a seal provided to the other one of the doors 16 can seal the entrance to the fresh food compartment 14 at a location between opposing side surfaces 17 (FIG. 2) of the doors 16. The flipper mullion can be pivotally coupled to the door 16 to pivot between a first orientation that is substantially parallel to a planar surface of the door 16 when the door 16 is closed, and a different orientation when the door 16 is opened. The externally-exposed surface of the flipper mullion 21 is substantially parallel to the door 16 when the flipper mullion 21 is in the first orientation, and forms an angle other than parallel relative to the door 16 when the flipper mullion 21 is in the second orientation. The seal and the externally-exposed surface of the flipper 21 cooperate approximately midway between the lateral sides of the fresh food compartment 14.

A dispenser 18 for dispensing at least ice pieces, and optionally water can be provided to one of the doors 16 that restricts access to the fresh food compartment 14 shown in FIG. 1. The dispenser 18 includes a lever, switch, proximity sensor or other device that a user can interact with to cause frozen ice pieces to be dispensed from an ice bin 35 (FIG. 2) provided to an ice maker 20 disposed within the fresh food compartment 14 through the door 16. Ice pieces from the ice bin 35 can be delivered to the dispenser via an ice chute 25, which extends at least partially through the door 16 between the dispenser 18 and the ice bin 35.

Referring once again to FIG. 1, the freezer compartment 12 is arranged vertically beneath the fresh food compartment 14. A drawer assembly (not shown) including one or more freezer baskets (not shown) can be withdrawn from the freezer compartment 12 to grant a user access to food items stored in the freezer compartment 12. The drawer assembly can be coupled to a freezer door 11 that includes a handle 15. When a user grasps the handle 15 and pulls the freezer door 11 open, at least one or more of the freezer baskets is caused to be at least partially withdrawn from the freezer compartment 12.

The freezer compartment 12 is used to freeze and/or maintain articles of food stored in the freezer compartment 12 in a frozen condition. For this purpose, the freezer compartment 12 is in thermal communication with an icemaker evaporator (FIG. 2) that removes thermal energy from the freezer compartment 12 to maintain the temperature therein at a temperature of 0° C. or less during operation of the refrigerator 10 in a manner described below.

The fresh food compartment 14 located in the upper portion of the refrigerator 10 in this example, serves to minimize spoiling of articles of food stored therein by maintaining the temperature in the fresh food compartment 14 during operation at a cool temperature that is typically less than an ambient temperature of the refrigerator 10, but somewhat above 0° C., so as not to freeze the articles of food in the fresh food compartment 14. According to some embodiments, cool air from which thermal energy has been removed by the icemaker evaporator can also be blown into the fresh food compartment 14 to maintain the temperature therein at a cool temperature that is greater than 0° C. For alternate embodiments, a separate evaporator can optionally be dedicated to separately maintaining the temperature within the fresh food compartment 14 independent of the freezer compartment 12. According to an embodiment, the temperature in the fresh food compartment can be maintained at a cool temperature within a close tolerance of a range between 0° C. and 4.5° C., including any subranges and any individual temperatures falling with that range. For example, other embodiments can optionally maintain the cool temperature within the fresh food compartment 14 within a reasonably close tolerance of a temperature between 0.25° C. and 4° C.

The refrigerator 10 further includes a refrigeration system comprising a system evaporator 27 for providing a cooling effect to at least one of the fresh food and freezer compartments. An embodiment of the system evaporator 27 for cooling air for both the freezer compartment 12 and the fresh food compartment 14 is shown in FIG. 2. The system evaporator 27 is supported within the freezer compartment 12, and an electric fan 29 is located adjacent to the system evaporator 27. In one example, operation of the electric fan 29 draws the airflow upward over the fins and coils of the system evaporator 27, and then in a forward direction, generally parallel to the ceiling portion of the freezer compartment 12 and toward a front of the freezer compartment 12. A cover (not shown) positioned in front of the horizontally-oriented electric fan 29 redirects at least a portion of the horizontal airflow generally upward through a cool air duct to be reintroduced into the fresh food compartment 14.

The system evaporator 27 is included as part of a refrigeration circuit provided to the refrigerator 10 for removing thermal energy from air to be used for controlling temperatures in at least one of the fresh food compartment 14 and the freezer compartment 12, and also for reducing a temperature of an ice maker evaporator (FIG. 3) for freezing water into the ice pieces and for maintaining a temperature in the ice bin 35 provided to the ice maker 20. In one example, the refrigeration circuit includes a variable-speed compressor for compressing gaseous refrigerant to a high-pressure refrigerant gas. The compressor can optionally be infinitely variable, or can be varied between a plurality of predetermined, discrete operational speeds depending on the demand for cooling. The high-pressure refrigerant gas from the compressor can be conveyed through a suitable conduit such as a copper tube to a condenser, which cools the high-pressure refrigerant gas and causes it to at least partially condense into a liquid refrigerant. From the condenser, the liquid refrigerant can optionally be transported through an eliminator tube that is embedded within a portion of the center mullion. The liquid refrigerant flowing through the eliminator tube elevates the temperature of the external surface of the center mullion to minimize the condensation of moisture from an ambient environment of the refrigerator 10 thereon. Alternatively, an electric AC or DC mullion heater can be utilized to control condensation on the center mullion. According to alternate embodiments, the refrigerator 10 includes a humidity sensor for sensing a humidity of an ambient environment in which the refrigerator 10 is in use, and controlling operation of the eliminator tube or mullion heater.

In operation, the compressor compresses the substantially-gaseous refrigerant to a high pressure, high-temperature refrigerant gas. As this refrigerant travels through the condenser it cools and condenses into a high-pressure liquid refrigerant. The refrigerator subsequently enters the system evaporator 27, where the refrigerant expands and at least partially evaporates into a gas. During this phase change, the latent heat of vaporization is extracted from air being directed over fins and coils of the system evaporator 27, thereby cooling the air to be directed by the electric fan 29 into at least one of the freezer compartment 12 and the fresh food compartment 14. This cooled air brings the temperature within the respective compartment to within an acceptable tolerance of a target temperature. From the system evaporator 27, the refrigerator flows to the ice maker evaporator. In one example, the ice maker evaporator is arranged in series with the system evaporator 27. Thus, operation of the system evaporator 27 to cool the freezer compartment 12 and the fresh food compartment 14 also causes the ice maker evaporator to provide air cooled to a temperature below zero degrees Centigrade to the ice maker 20. An air mover, such as a fan, can drive or circulate airflow over the ice maker evaporator to facilitate a cooling effect to the water in the water tray sufficient for freezing the water into ice pieces and also to the ice pieces stored in the ice bin 35 to minimize melting of those ice pieces. From the ice maker evaporator, the refrigerant returns to the compressor; however, it is also contemplated that the refrigerant could first be supplied to the ice maker evaporator and second to the system evaporator 27, and then finally is returned to the compressor.

It is contemplated that the icemaker evaporator can be arranged in series or parallel with the system evaporator 27, or could even be provided as a separate system. Along these lines, various control valves, pressure regulators, dryers, accumulators, etc. can be provided in between the system evaporator and the ice maker evaporator, and/or the ice maker evaporator and the compressor. Where the icemaker evaporator is arranged in series with the system evaporator 27, stopping and starting operation of either evaporator will also stop/start operation of the other. However, where the icemaker evaporator is arranged in parallel with the system evaporator 27, stopping and starting the icemaker evaporator could be accomplished via opening or closing a valve or the like. Where the icemaker evaporator is independent of the system evaporator 27, stopping and starting the icemaker evaporator could be accomplished by valves or even by controlling operation of the associated refrigerant compressor. Finally, where a variable-speed refrigerant compressor is used, it is understood that "stopping" operation of the compressor may be accomplished by operating the compressor at a low, such as the lowest, operational setting above deactivation to substantially reduce the flow of refrigerant. Still, the compressor could also be completely deactivated.

Additionally, it is contemplated that the ice maker refrigeration circuit could include an electronic expansion valve that is configured to control the flow of refrigerant entering the ice maker evaporator. The electronic expansion valve allows the flow of refrigerant to the portion of the refrigeration circuit including the ice maker evaporator (this portion being referred to hereinafter as the "Ice Maker Path") independently of the portion of the refrigeration circuit including the system evaporator 27 for controlling the temperature within at least one of the freezer compartment 12 and the fresh food compartment 14 (this portion being referred to hereinafter as the "System Path"). Thus, the flow of refrigerant to the ice maker evaporator can be discontinued as appropriate during ice making as described in detail below even though the compressor is operational and refrigerant is being delivered to the system evaporator 27. Additionally, the opening and closing of the electronic expansion valve can be controlled to regulate the temperature of at least one of the ice maker evaporator. A duty cycle of the electronic expansion valve, in addition to or in lieu of the operation of the compressor, can be adjusted to change the amount of refrigerant flowing through the ice maker evaporator based on the demand for cooling. There is a greater demand for cooling by the ice maker evaporator while water is being frozen to form the ice pieces than there is when the ice pieces are not being produced. The electronic expansion valve can be located at a point before (i.e., upstream of) the ice maker evaporator so the refrigerator 10 can operate at its desired state. In other words, the system evaporator 27 can be supplied with the refrigerant by the compressor even when the ice maker is not making ice pieces. It is therefore possible to avoid changing the operation of the compressor while the electronic expansion valve is operational to account for the needs of the ice maker evaporator.

When ice is to be produced by the ice maker, a controller can at least partially open the electronic expansion valve. Refrigerant from the dryer delivered to the Ice Maker Path through a capillary tube provides thermal energy via an ice maker heat exchanger to the refrigerant returning from the Ice Maker Path. After passing through the electronic expansion valve the refrigerant enters the ice maker evaporator where it expands and at least partially evaporates into a gas. The latent heat of vaporization required to accomplish the phase change is drawn from the ambient environment of the icemaker evaporator, thereby lowering the temperature of an external surface of the ice maker evaporator to a temperature that is below 0° C. Water exposed to the external surface of the ice maker evaporator is frozen to form the ice pieces. An optional fan or other air mover can direct airflow throughout the ice maker compartment to cool the ambient environment of ice pieces stored in the ice bin to minimize melting of those ice pieces.

Still, it is contemplated that the ice maker evaporator can be arranged in series with the system evaporator 27. In such a configuration, an electronic expansion valve may not be used. Instead, the ice maker evaporator will be cooled together with the system evaporator 27, via operation of the compressor and the rest of the refrigeration system. The ice maker can receive refrigerant first, and then the refrigerant flows to the freezer (or vice-versa, depending upon system design). Thus, cooling of the ice maker evaporator can occur each time a cooling cycle is initiated for the system evaporator 27, or operation of the refrigeration system can be controlled by a call for cooling of the ice maker evaporator (e.g., by the start of an ice making operation). Additionally, during ice harvesting or defrosting, a three-way valve 100 (FIG. 6) can be used to divert refrigerant around the ice maker and away from the ice maker evaporator. As can be appreciated, various control schemes for the system evaporator and ice maker evaporation can be used.

An illustrative embodiment of the ice maker 20 disposed within the fresh food compartment 14 of the refrigerator 10 is shown in FIG. 2. The ice maker 20 can be secured within the fresh food compartment using any suitable fastener, and includes a removable or non-removable cover 40 for providing thermal insulation between the fresh food compartment 14 and the interior of the ice maker 20. Further, the cover 40 can include a substantially planar partition that can be removably or non-removably coupled to a lateral side of the ice maker 20, can have a generally "L" shaped appearance when viewed on end so as to enclose a lateral side and bottom portion of the ice maker 20 when installed, can have a generally "U" shaped appearance when viewed on end so as to enclose both lateral sides and the bottom portion of the ice maker 20 when installed, or any other desired shape. Such embodiments of the insulated cover 40 can include the side and bottom portions monolithically formed as a single unit. According to alternate embodiments, the insulated cover 40 can include a plurality of insulated panels that are spaced apart from each other to establish a passageway between the individual insulated panels through which ice pieces can be dispensed from the ice maker 20. Such embodiments can eliminate the need to form complex panels that define the entire perimeter of an ice-dispensing aperture through which ice can be dispensed from the ice maker 20. For example, a bottom insulated panel for insulating a bottom portion of the ice maker 20 can be spaced rearward, into the fresh food compartment, from a front insulated panel that opposes a door restricting access into the fresh food compartment and insulates a front portion of the ice maker 20. The resulting space between the front and bottom insulated panels forms an aperture through which ice pieces can be dispensed.

Various perspective and side views of the ice maker 20 removed from the interior of the fresh food compartment 14 are illustrated in the drawings. A generally rectangular body defines an ice making chamber in which an ice making assembly is disposed. The body is equipped with a plurality of receivers compatible with the fasteners used to secure the ice maker 20 within the fresh food compartment 14 of the refrigerator 10. The ice bin and the cover 40 can be selectively removed from and secured to the body as desired. Although the cover 40 provides a degree of insulation between the ice making chamber of the ice maker 20 and the fresh food compartment 14, its construction may inhibit a hermetic seal from being formed between the ice making chamber and fresh the food compartment 14. In other words, the cover 40 can optionally allow minimal amounts of thermal energy transfer to occur between the ice making chamber of the ice maker 20 and the fresh food compartment 14. Alternatively, various seals and/or relatively tight tolerances can be used to obtain a nearly or fully hermetic seal. The cover 40 can optionally be removably secured in place on the ice maker 20 by releasable mechanical fasteners that can be removed using a suitable tool, examples of which include screws, nuts and bolts; or any suitable friction fitting possibly including a system of tabs allowing removal of the cover 40 from the ice maker 20 by hand and without tools. Alternatively, the cover 40 can optionally be non-removably secured in place on the ice maker 20, such as via adhesives, welding, non-removable fasteners, etc. In various other examples, a hidden latch is desirable for cosmetic and ergonomic reasons. The appearance of ice bin 35 front can be clean with only a hand-hold on the side. There can be few or no discontinuities in the surface for the purpose of exposed latches or levers.

The ice bin 35 can optionally be removably installed in the ice maker 20 to grant access to ice pieces stored therein. An aperture 42 formed along a bottom surface of the ice bin 35 is aligned with the aperture 30 leading into the ice chute 25 when the door 16 including the dispenser 18 is closed and allows for frozen ice pieces stored therein to be conveyed to the ice chute 25 and dispensed by the dispenser 18. A rotatable auger can extend along a length of the ice bin 35 can optionally be provided to be rotated and urge ice towards the aperture 42 formed along the bottom surface adjacent a front portion of the ice bin 35 to be transported to the ice chute 25 and dispenser 18. The auger can optionally be automatically activated and rotated by an electric motor in response to a request for ice pieces initiated by the user at the dispenser 18.

Figure 3:
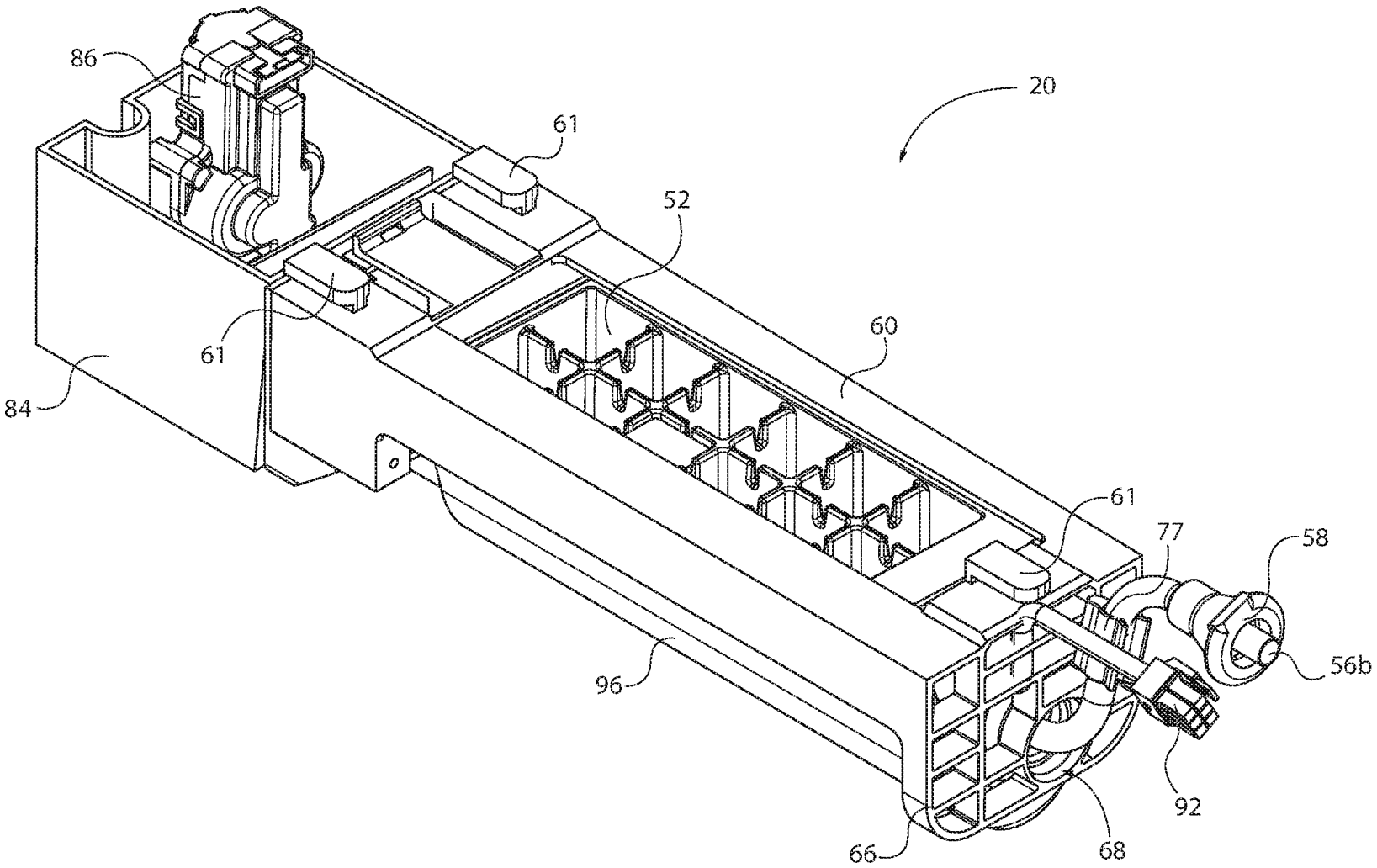
FIG. 3 is a top perspective view of an example ice maker.

Turning now to FIG. 3, one embodiment of an ice maker 20 is shown for freezing and congealing water into ice pieces. The ice maker is generally supported adjacent to a ceiling within the ice making chamber. Although the ice making chamber is shown illustrated within the main interior storage cabinet of the fresh food compartment, it is contemplated that the ice maker 20 could be supported partially or completely upon the fresh food compartment door(s). The ice maker 20 includes an ice mold 52 with a plurality of cavities for storing water to be frozen into the ice pieces. The cavities are defined by weirs, and some or all of the weirs have an aperture therethrough to enable water to flow among the cavities. The ice mold 52 cavities can have multiple variants. Different cube shapes and sizes are possible (e.g., crescent, cubical, hemispherical, cylindrical, star, moon, company logo, a combination of shapes and sizes simultaneously, etc.) since the cubes are harvested with gravity. This flexibility of mold shape is possible by changing the ice mold tray, at the factory, by a service technician, or even possibly by the end user if the system is so designed.

As will be described herein, the ice mold 52 is rotatable between an ice-forming position (e.g., a normal operative position of the ice mold or right-side up) and an ice-harvesting position (e.g., upside down). In the ice-harvesting position, the ice mold 52 is positioned so that the congealed ice pieces will fall by gravity into a subjacent ice bin 35 (see FIG. 2, not shown in FIG. 3) for storage and later discharge to a user. In one example, the ice-harvesting position is inverted at least 180 degrees with respect to the ice-forming position. In other examples, the ice-harvesting position can be inverted to any angle between 90 degrees and 180 degrees, or alternatively, to an angle greater than 180 degrees. Still, in other embodiments, the ice mold could comprise a twist-tray type, in which the water mold is rotated upside down and twisted along its longitudinal axis to thereby break the frozen ice pieces free from the ice cavities where they fall into the ice bin located below the ice mold, or even a conventional metal mold, in which a plurality of sweeper-arms are used for forcibly discharging the ice pieces from the mold.

The ice maker 20 can also include a bail arm or other contact or non-contact sensor for sensing the presence of ice pieces within the ice bin. A thermistor or other suitable temperature sensor operatively connected to the controller can be coupled to the ice mold 52, such as connected to a surface of the ice mold or embedded within a recess formed in the ice mold, for detecting temperature to determine the freezing status of the water contained in the ice mold 52 to facilitate ice harvesting. The temperature sensor may also be used to determine the length of time to operate the heater. One or more switches can also be provided to the ice making assembly to determine when the mold has reached a travel limit. The bail arm can actuate a switch to signify an upper limit and/or absence of ice pieces in the ice bin.

The ice maker 20 of the instant application employs a direct cooling approach, in which an ice maker evaporator 54 is in direct (or substantially direct) contact with the ice mold 52. The ice pieces are made without cold air ducted from a remote location (e.g., a freezer) to create or maintain the ice. Instead, all cooling can be done within the ice maker compartment by the ice maker evaporator 54. It is understood that direct contact is intended to mean that the ice maker evaporator 54 abuts the ice mold 52, or is substantially in contact with the ice mold via a relatively small intermediary, such as a thermal grease/mastic that can be used between the outside surface of the ice maker evaporator and the surface of the ice mold to facilitate heat transfer. Various other solid, liquid, or even gaseous intermediaries could also be used. Additionally, although no air is typically ducted from a remote location (e.g., a freezer) to create or maintain the ice, it is contemplated that cold air could be ducted from another location, such as about the system evaporator 27, if desired to increase a rate of ice making production or to maintain the stored ice pieces in the ice bin at a frozen state. This could be useful, for example, in a configuration where the ice bin is separated or provided at a distance apart from the ice maker evaporator 54, or where accelerated ice formation is desired.

The dedicated ice maker evaporator 54 removes thermal energy from water in the ice mold 52 to create the ice pieces. As described previously herein, the ice maker evaporator 54 can be configured to be a portion of the same refrigeration loop as the system evaporator 27 that provides cooling to the fresh food and/or freezer compartments of the refrigerator. In various examples, the icemaker evaporator 54 can be provided in serial or parallel configurations with the system evaporator 27. In yet another example, the ice maker evaporator 54 can be configured as a completely independent refrigeration system. The ice maker evaporator 54 can include a metal tube 55 or the like, with a longitudinal axis and a generally rounded exterior surface (or even various other exterior surface profiles). The metal tube 55 encloses a refrigerant inlet line **56*a* and a refrigerant outlet line 56*b*, so that the refrigerator can flow into and out of the ice maker evaporator 54 during operation of the refrigerant system. The inlet line 56*a* is in fluid communication with the capillary tube, which could be located nearby or even inside of the metal tube 55 of the ice maker evaporator 54. Further, a grommet 58 or the like can be used to partially support the inlet and/or outlet lines 56*a*, 56*b***. Still, although the term "evaporator" is used for simplicity, in yet another embodiment the ice maker evaporator could instead be a thermoelectric element (or other cooling element) that is operable to cool the ice mold to a sufficient amount to congeal the water into ice pieces. Similar operative service lines (such as electrical lines) can be provided similar to the inlet/outlet lines described above.

The ice maker evaporator 54 also serves as a pivot axis for the ice mold 52, which rotates around the ice maker evaporator 54 between the ice-forming position and the ice-harvesting position, while the ice maker evaporator 54 remains stationary. For example, a rotational axis of the ice mold is co-axial with the longitudinal axis of the ice maker evaporator 54. In view of this rotating feature, it is beneficial for the exterior surface of the icemaker evaporator 54 to have a substantially circular geometry, although it is contemplated that various other geometries could be used. Similarly, the underside surface of the ice mold 52 that is in contact with the ice maker evaporator 54 is a complementary geometry that facilitates rotation of the ice mold 52 around the stationary ice maker evaporator 54.

A frame 60 is provided to support the ice mold 52 and the ice maker evaporator 54 within the ice making chamber. The frame 60 may be provided with various mounting structure, such as mounting lugs 61 on an upper surface thereof for mounting to receiving structure on a ceiling of the ice making compartment or fresh food compartment. Various other mechanical fastening structure can also be used. Of course, various other mounting structures can be provided on the frame 60 as desired for mounting the ice maker 20 at various locations within the fresh food compartment or even on the fresh food compartment door(s). The frame 60 extends from a first end 62 of the ice mold 52 to a second end 64 of the ice mold 52, and rotatably supports the ice mold 52 within the fresh food compartment between the ice-forming position and the ice-harvesting position. Additionally, the frame 60 supports the ice maker evaporator 54 at a stationary position that serves as a pivot axis for the first end 62 of the ice mold 52 so that the ice mold 52 can rotate around the ice maker evaporator 54 between the ice-forming position and the ice-harvesting position, while the ice maker evaporator 54 remains stationary. Use of the word "stationary" is intended to apply to the refrigerant lines (i.e., evaporator inlet and outlet lines), with the understanding that some portion of the outer metal tube 55 that encloses the refrigerant lines could potentially be configured to rotate (for example, rotate with the ice mold 52).

The frame 60 can rotatably support the ice mold 52 in various manners. In one example, a first end of the frame 60 can include a downward wall 66 with a through hole 68 extending therethrough. The through hole 68 can have a circular geometry that mates with a pivot pin of the first end 62 of the ice mold 52. A rotational support, such as a bearing or bushings, could be provided between the ice mold 52 and the through hole 68. An underside of the frame 60 can be generally open, so that when the ice mold 52 is inverted to the ice-harvesting position, the harvested ice pieces can fall by gravity without obstruction into the ice bin. The frame 60 further includes a second end 69, located opposite the first end 62, that can contain other elements of the ice maker 20.

The ice maker 20 can further include a cooling plate 70 coupled to an underside of the ice mold 52. The cooling plate 70 can extend between the first and second ends 62, 64 of the ice mold 52. The cooling plate 70 may include heat exchange fins or the like on a bottom or side surfaces thereof to enhance heat transfer throughout the ice making compartment. The cooling plate 70 is preferably metal or other material that has a high heat exchange coefficient, and may be the same or different material as the ice mold 52. The cooling plate 70 is used as a thermal heat sink with the icemaker evaporator 54 to enable substantially uniform heat transfer throughout the entire ice mold 52, either in a cooling operation (e.g., ice forming) or heating operation (e.g., ice harvest or defrosting).

Figure 6:
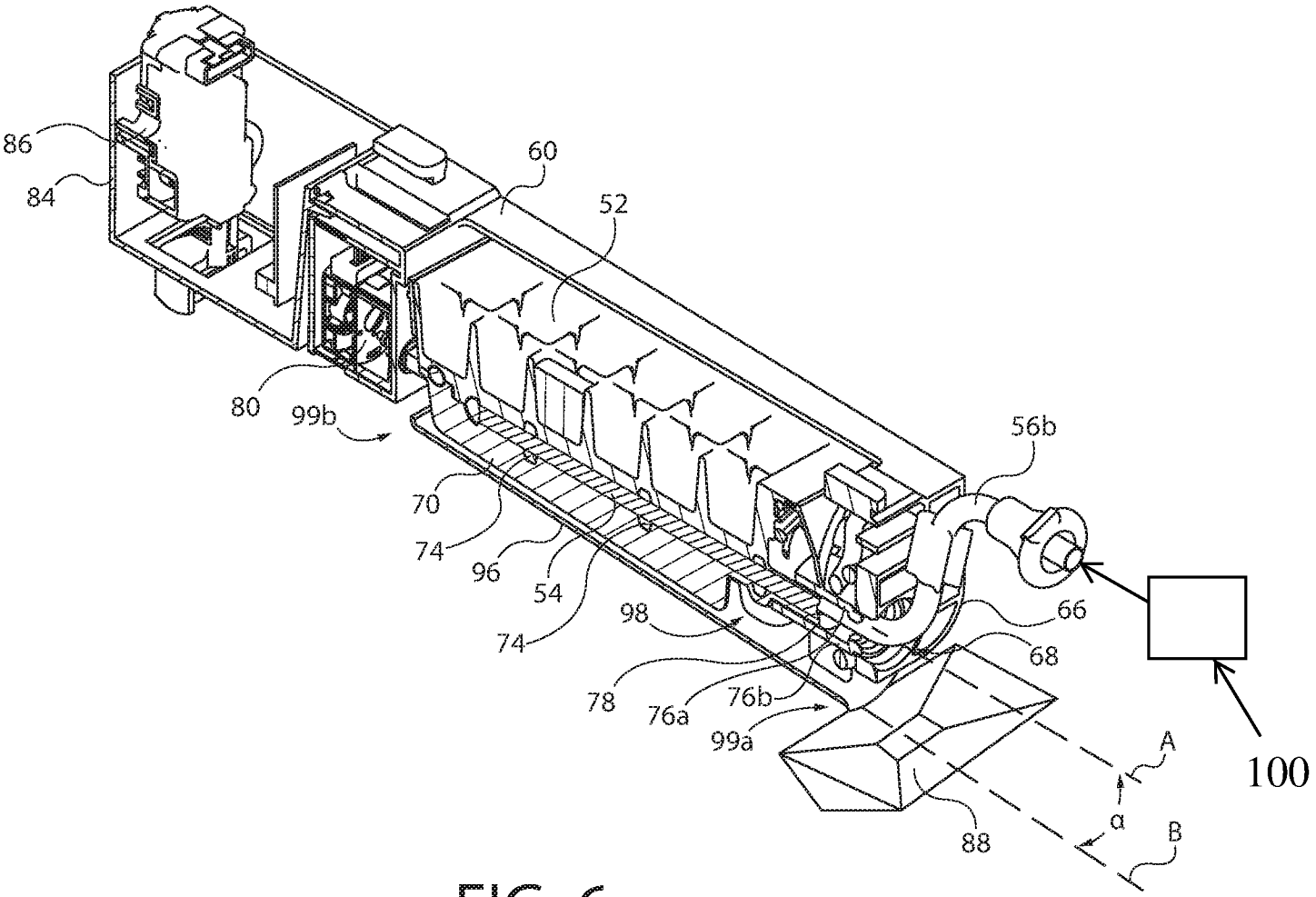
FIG. 6 a sectional view taken along line 6-6 of FIG. 5.
Figure 7:
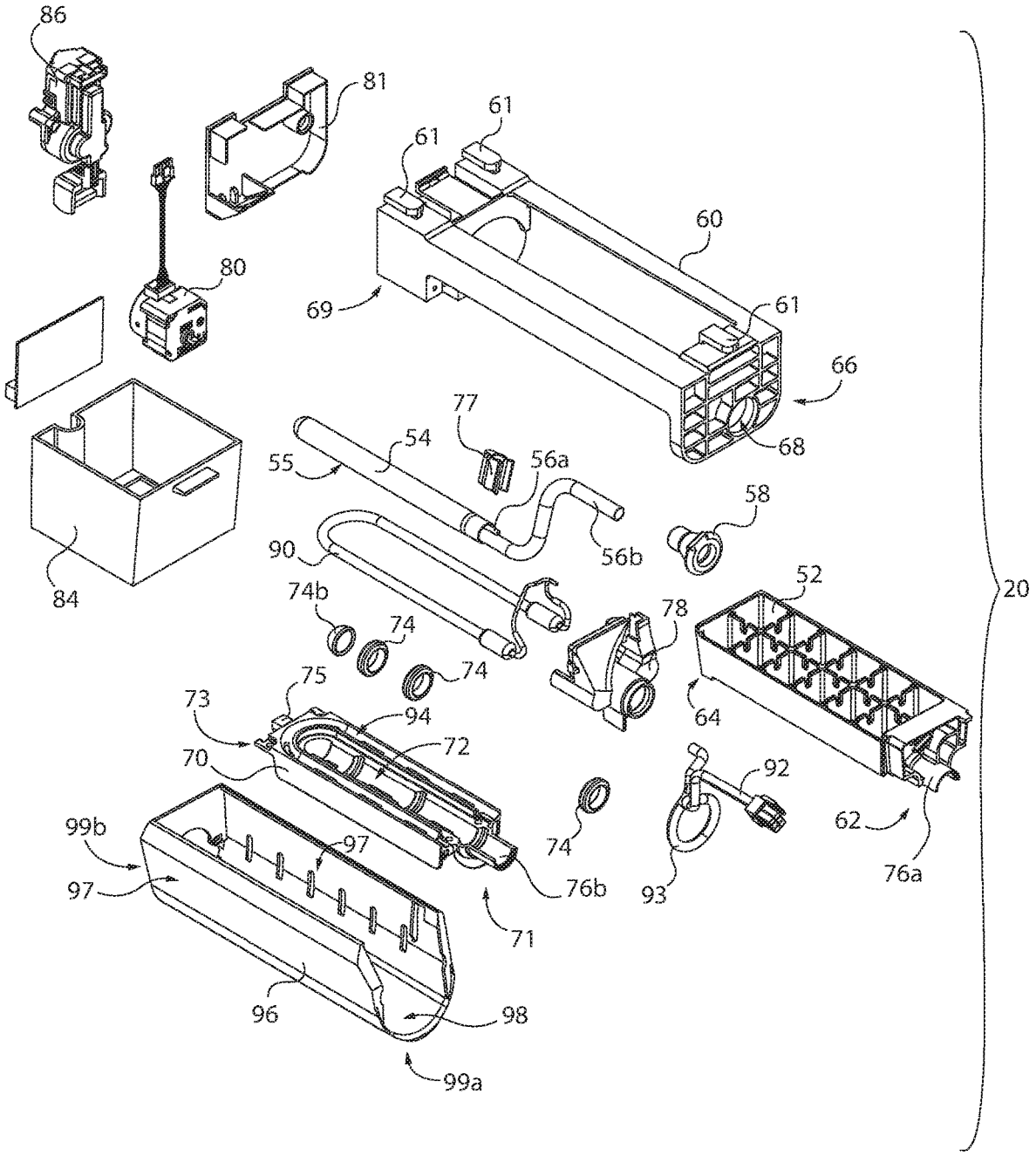
FIG. 7 is a perspective, exploded view of the ice maker.

The ice maker evaporator 54 is captured between the cooling plate 70 and the ice mold 52, as shown in the example of FIGS. 6-7. The ice maker evaporator 54 can be physically mounted to either or both of the cooling plate 70 and the ice mold 52, or it can be retained by a clamping action when the cooling plate 70 is secured to the ice mold 52. In this manner, the icemaker evaporator 54 is able to simultaneously cool both of the ice mold 52 and the cooling plate 70. The cooling plate 70 has an interior recess 72 that is complementary to the exterior geometry of the ice maker evaporator 54. Preferably, the interior recess 72 facilitates rotation of the ice mold 52 and cooling plate 70 around the stationary ice maker evaporator 54. A rotational support 74 is interposed between the ice maker evaporator 54 and the interior recess 72 of the cooling plate 70 to facilitate rotation. The rotational support 74 is one of a bearing and a bushing, or the like. Multiple rotational supports 74 can be used, such as the three illustrated in FIG. 7. The interior recess 72 of the cooling plate 70 can have pockets or other mounting points to receive the rotational supports 74. Similarly, the underside surface of the ice mold 52 can have similar geometry. An optional end cap **74*b* can be provided with a suitable geometry to rotationally support the end of the ice maker evaporator 54**. In one example, a set of bearings/bushings separate the ice maker evaporator and the ice mold assembly, and a thermal grease/mastic is used in the space between the outside surface of the evaporator and the inside surface of the mold assembly for heat transfer. One end of the space for the ice maker evaporator is closed off, while a rotating seal is used at the other end to enclose the thermal grease/mastic.

The frame 60 rotatably supports both of the ice mold 52 and the cooling plate 70. The cooling plate 70 can have a pivot pin that mates with the through hole 68 of the frame 60. In one example, the ice mold 52 and the cooling plate 70 can together form a combined pivot pin that is rotatably supported by the frame 60. In the example shown in FIG. 7, a first end 71 of the cooling plate 70 and the first end 62 of the ice mold 52, when assembled together, form a pivot pin that is rotatably supported by the through hole 68 of the frame 60 to rotatably support both of the ice mold 52 and the cooling plate 70. Each of the ice mold 52 and the cooling plate 70 can provide, for example, one half of the pivot pin. In this case, a dividing face of the pivot pin is formed on a plane passing an axial center of the pin, so that the pivot pin is substantially bisected into two pieces **76*a*, 76*b* each formed in a roughly half-cylindrical shape. In other words, the dividing face of the pivot pin can be substantially parallel to the horizontal plane. Of course, it is contemplated that each of the ice mold 52 and cooling plate 70 can provide more or less than one half of the pivot pin geometry. The pivot pin formed by the assembled ice mold 52 and cooling plate 70 can be directly rotatably supported by the through hole 68, or there can be a rotational support interposed therebetween such as a bearing or bushing. In yet another example, the pivot pin can be received within an intermediate rotational support 78, which may be used to support other elements of the icemaker 20** as will be described in greater detail herein.

Furthermore, to enable the ice mold 52 and cooling plate 70 to be rotatable about the stationary ice maker evaporator 54, the ice maker evaporator 54 can extend through an interior passage of the pivot pin that is formed by the assembled ice mold 52 and cooling plate 70. In this manner, the pivot pin is a hollow pin. As shown in the example of FIG. 7, each of the two pieces **76*a*, 76*b* of the assembled pivot pin can have an open cylindrical interior the permits some portion of the ice maker evaporator 54, such as either or both of the inlet and outlet tubes 56*a*, 56*b* to pass therethrough. Rotational supports can be provided, if desired, or the interior passage of the pivot pin can be relatively larger than the space occupied by the inlet/outlet tubes, etc. This can be useful where, for example, rotational supports 74 are already in place. Indeed, as shown in FIG. 7, one of the rotational supports 74 can be located adjacent the pieces 76*a*, 76*b* of the pivot pin. Additionally, a mount or a spacer, such as an isolation device 77, can be interposed between the inlet/outlet lines of the icemaker evaporator and the downward wall 66 of the frame. The device 77 can be connected to the wall 66**, or may simply rest against the wall.

The second ends 64, 73 of both the ice mold 52 and the cooling plate 70 are also rotationally supported by the second end 69 of the frame 60. In one example, a second end 73 of the cooling plate is supported by a motor 80 that provides motive force to rotate both of the cooling plate and ice mold between the ice-forming position and the ice-harvesting position. This configuration also provides support for the second end 64 of the ice mold 52, since the ice mold 52 is attached directly to the cooling plate 70. The motor 80 can include an electric motor, for example, that is housed within an interior cavity of the second end 69 of the frame 60 (which may be closed by an end wall 81). Thus, the motor 80 drives the ice mold 52 between the ice-making position and an ice-harvesting position. The motor 80 can include an internal or external gearbox, and has an output drive shaft that is positioned along the pivot axis of the ice mold 52. The cooling plate 70 is operatively connected to the output drive shaft of the motor 80 by a straight, rigid drive pin 75 or the like. Alternatively the cooling plate 70 could have a keyed recess or the like to receive the shaft of the motor 80. Alternatively, the output drive shaft of the motor 80 could be operatively connected to the ice mold 52 instead of the cooling plate 70. In operation, the ice pieces are harvested by rotating the ice mold assembly, including both of the ice mold 52 and cooling plate 70, up to 180 degrees (or a greater or lesser angle) while heating the ice mold 52 so that the ice pieces can fall out of the mold due to gravity when melted free from the mold.

It is further contemplated that the frame 60 could be coupled to additional structure of the ice maker and/or ice bin. For example, as shown in FIG. 7, an auxiliary enclosure 84 can be located at one end 69 of the frame 60 and can enclose auxiliary structure 86, such as a controller, bail arm assembly, various sensors, a fan, etc. It is contemplated that the auxiliary enclosure 84 could be mounted to the refrigerator, and the frame 60 could be mounted thereto; vice-versa, the frame 60 can be mounted to the refrigerator with the auxiliary enclosure 84 supported by the frame 60. It is further contemplated that the motor 80 could be housed within the enclosure 84. The motor 80 could even be electrically and/or mechanically coupled to the auxiliary structure 86.

The ice maker 20 can further include a heater 90 that is operable to provide a heating effect to the ice mold 52 to thereby separate congealed ice pieces from the ice mold 52 during an ice harvesting operation. The heater 90 can be an electric resistance heater, and can be captured between the cooling plate 70 and the ice mold 52. The heater 90 is preferably received within a corresponding recess 94 that extends throughout the cooling block 70. As a result, the cooling block 70 facilitates substantially uniform heat transfer throughout the entire ice mold 52 during a heating operation (e.g., ice harvest or defrosting). Additionally, because the heater 90 is attached to the cooling block 70, the heater 90 is rotatable together with the cooling block 70 and ice mold 52. The heater 90 could further be coupled to the intermediate rotational support 78, and may even form a sub-assembly therewith.

Electrical power can be supplied to the heater 90 by an electrical connection block 92, which can have various geometries to enable the rotation of the ice mold 52 and cooling block 70. An electrical supply wire 93 of the electrical connection block 92 can have a curved profile, and may be arranged as a loop that extends around the exterior of the pivot pin pieces 76*a*, 76*b*, so that there is sufficient flex and length in the wire 93 to enable the rotation of the heater 90 together with the cooling plate 70 and the ice mold 52 without binding the electrical wires. Preferably, the heater 90 is in direct or substantially direct contact with the ice mold 52 for increased heat transfer. It is further contemplated that the heater 90 can be received within a corresponding recess of the ice mold 52, or that the cooling block 70 and ice mold 52 can each provide a portion of the recess for mounting the heater 90.

While the heater 90 is used to melt the ice free from the mold during ice harvesting, it is also used to heat the cooling plate 70 to defrost it periodically after continued use. Occasionally during operation of the refrigerator, the ice maker cooling plate 70 (and/or even a portion of the ice mold 52) will accumulate frost thereon and require defrosting. Moisture from airflow can condense and freeze on exposed portions of the cooling plate 70 and/or ice mold 52, causing frost to accumulate thereon. The heater 90 can be used as a defrost heating element and can be activated as appropriate by the controller provided to the refrigerator to melt the frost. In order to facilitate the defrosting operation, the heater 90 preferably extends along some or all or the perimeter of the cooling plate 70. As shown in FIG. 7, the heater 90 can have a U-shaped geometry that extends around the outer perimeter of the cooling plate 70 and the ice maker evaporator 54.

The operation of the heater 90 for a defrost operation can be triggered to operate in various manners, such as periodically or in response to a particular condition. In one example, heater 90 can be triggered based on a timer, a humidity sensor, operational history of the icemaker, opening/closing of the refrigerator doors, operation of the bail arm, and/or other conditions. In another example, a temperature sensor can optionally be positioned variously within the refrigerator 10 to sense a threshold temperature indicative of the accumulation of frost. For example, the temperature sensor of the ice mold 52 can be used, or another temperature sensor. In response to sensing such a threshold temperature, the temperature sensor transmits a signal to the controller which, in turn, activates the heater 90 until the temperature sensor no long senses the threshold temperature. According to various embodiments, the heater 90 can optionally be activated for a predetermined length of time, and the predetermined length of time can be varied based various factors. Additionally, during ice harvesting or defrosting, the three-way valve 100 (FIG. 6) can be used to divert refrigerant around the ice maker and away from the ice maker evaporator 54. This allows the system to stop cooling the ice maker while continuing to cool the freezer or fresh food compartments. After the ice harvest, the valve 100 (FIG. 6) redirects the refrigerant through the ice maker evaporator 54. As can be appreciated, a defrosting operation would not normally occur during an ice-making operation, but instead would be delayed until after the ice mold 52 has discharged the ice pieces.

During operation of the heater 90, either during an ice harvesting operation or especially during a defrost operation, liquid water will drip and fall downwards by gravity away from the cooling plate 70 and ice mold 52. This can present a problem when an ice storage bin is located directly beneath these components, as the liquid water drops would fall into the stored ice pieces and freeze, causing the ice to clump together. In order to alleviate this problem, the ice maker 20 further includes a drip tray 96 located underneath the cooling plate 70 and is rotatable together with the cooling plate 70 and ice mold 52. The drip tray 96 can be connected to either or both of the ice mold 52 and cooling plate 70, such that the frame 60 rotatably supports all of the ice mold, cooling plate, and drip tray. Opposed ends of the drip tray 96 are preferably at least partially open to enable passage of the pivot pin of the ice mold 52 and cooling plate 70, and also connection of the motor 80 to the drive pin 75 at the other end.

Figure 4:
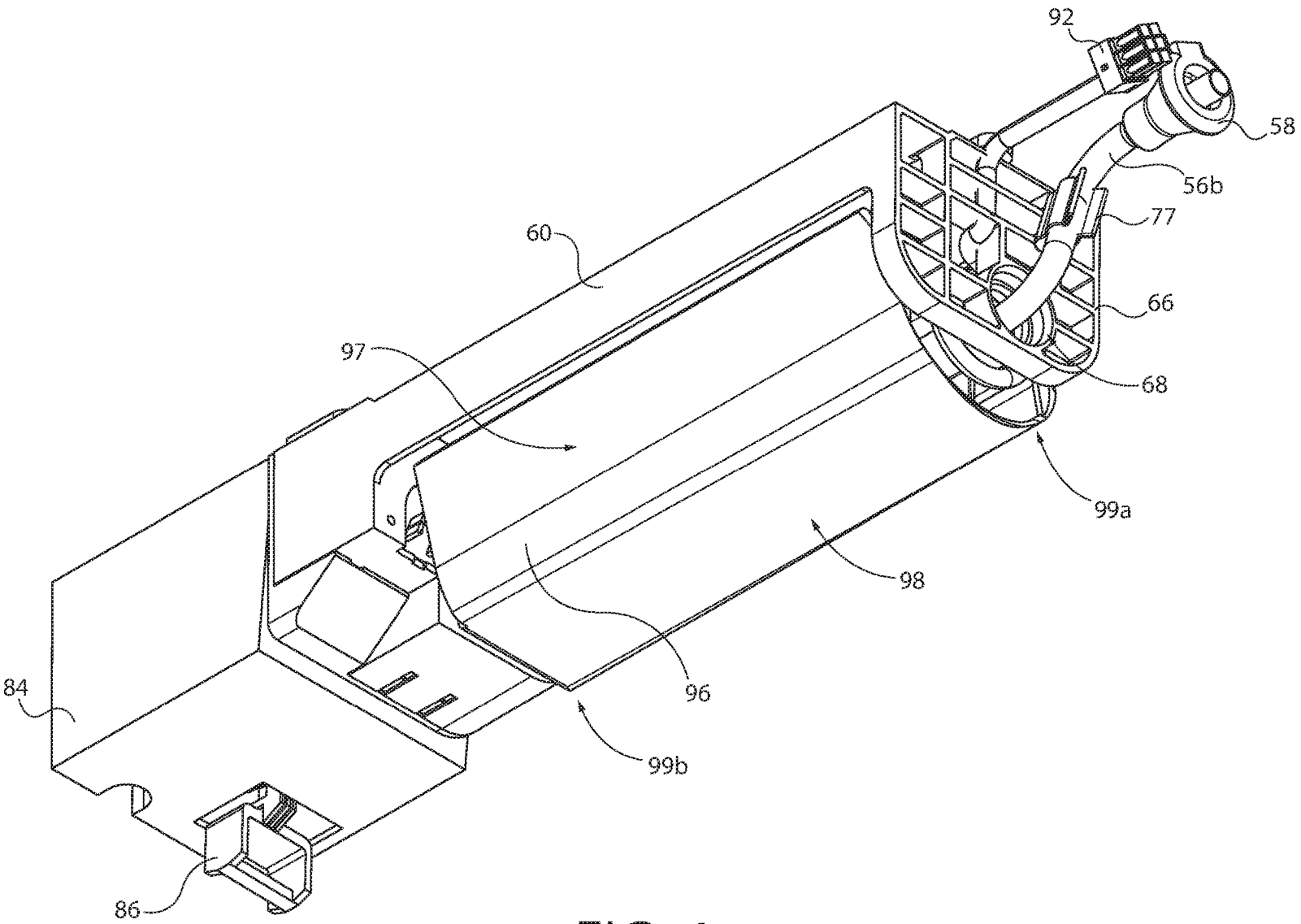
FIG. 4 is a bottom perspective view of the ice maker.
Figure 5:
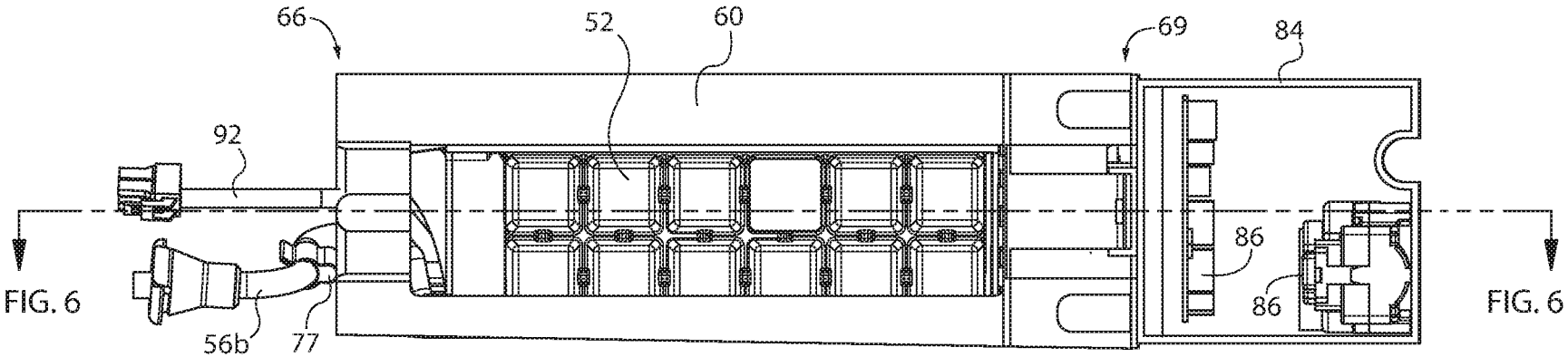
FIG. 5 is a top view of the ice maker.

The drip tray 96 extends between first and second ends 71, 73 of the cooling plate 70 to collect water droplets created when the heater 90 is operated. Preferably, the drip tray 96 also extends between the first and second ends 62, 64 of the ice mold 52 to collect water droplets created when the heater is operated. More preferably, the drip tray 96 extends beyond both of the first and second ends 71, 73 of the cooling plate 70, and the first and second ends 62, 64 of the ice mold 52, to capture substantially all of the water droplets. Additionally, as shown in the examples of FIGS. 4 and 6, sidewalls 97 of the drip tray 96 extend upwards from a bottom wall 98 to enclose the cooling plate 70 and ice mold 52 therein, and preferably substantially completely encloses the sides and bottom thereof. In this manner, the sidewalls 97 of the drip tray 96 form a sub-enclosure that helps to retain and focus the cooling of the ice maker evaporator 54 to accelerate cooling of the water in the ice mold 52, and further helps to retain the and focus heat supplied by the heater 90 during the ice harvesting or defrosting operations. Additionally, the upward sidewalls can further help to capture and retain any water droplets that may form and fall from the sidewalls of the ice mold 52 located above the cooling plate 70. In this manner, the motor 80 provides the motive force to rotate all of the cooling plate, the ice mold, and the drip tray between the ice-forming position and the ice-harvesting position.

After the drip tray 96 collects the water droplets, it can then direct them into a suitable drain tube (shown schematically in FIG. 4) of the refrigerator. It is contemplated that the term drain tube includes a conventional water drainage tube 88 that leads drain water to an exterior discharge space, but may also include another storage container or the like. In order to guide the drain water out of the drip tray 96, the bottom wall 98 of the drip tray 96 has an angled surface, relative to the pivot axis of the ice mold 52, that directs the collected water droplets in a direction downwards towards a drain tube 88. The bottom wall 98 can have a downwardly angled surface, relative to a normal operative position of the ice mold 52. For example, as shown in FIG. 4, a longitudinal plane B of the bottom wall 98 can diverge from the pivot axis A of the ice mold 52 at an angle $\alpha$ that is sufficient to encourage flow of the collected water droplets towards the drain tube 88. It is understood that the angle $\alpha$ can be slight, moderate, or aggressive, as desired, so long as the slope between the ends 99*a*, 99*b* of the bottom wall 98 encourages water drainage (i.e., end 99*b* is located at a higher vertical position relative to end 99*a*). Additionally, in order to encourage water flow towards the desired direction, the downwardly angled surface of the bottom wall 98 of the drip tray 96 is open at one end 99*a* to discharge the collected water droplets towards the drain tube 88. The open end 99*a* may include spout structure or the like to further direct the water droplets into the drain tube 88. Preferably, the opposite end 99*b* of the bottom wall 98 is either closed, or ramped/curved upwards to discourage discharge of the water droplets from that end. In one example, as shown in FIG. 4, the closed end 99*b* could have a relatively wider profile and the open end 99*a* could have a relatively narrower profile that defines a funnel and/or spout to encourage water flow towards the open end 99*a*. Additionally, some or all of the bottom wall 98 may further feature a curved or rounded profile that facilitates rotation of the ice mold 52, cooling plate 70 and drip tray 96. At least the exterior of the bottom wall 98 has a curved profile to provide clearance with upper support structure of the frame 60 when the assembly is rotated to the inverted, ice-harvesting position. The interior of the bottom wall 98 may or may not have a corresponding curved profile.

In another embodiment, it is contemplated that an air mover, such as an electric fan (not shown), can be used to promote air circulation around ice mold 52 and cooling plate 70 to further encourage accelerated ice formation, similar to an approach used in a more conventional fresh food ice maker system. The fan can drive airflow over the ice mold 52 to achieve a cooling effect to the water sufficient for freezing the water into ice pieces, and also across the ice pieces stored in the ice bin to minimize melting of those ice pieces. In addition or alternatively, the fan can be arranged to blow airflow across the ice mold and/or cooling plate 70 to thereby chill the air and help maintain the ice in the ice bin at a frozen condition. Airflow can even be directed or funneled through the drip tray 96 below the cooling plate 70 further enhance the transfer to the air. Finally, it is contemplated that the rotating ice maker design described herein could even be installed in a freezer compartment (e.g., an environment below 0 degrees Centigrade), either within the freezer cabinet or even on a freezer door, without the ice maker evaporator 52 in a more conventional configuration to make ice with the cold freezer air.

In addition or alternatively, the rotating ice maker 20 of the instant application may further be adapted to mounting and use on a fresh food door. In this configuration, although still disposed within the fresh food compartment, at least the ice maker 20 (and possibly an ice bin) is mounted to the interior surface of the fresh food door. For example, the frame 60 could be mounted to the interior liner of the fresh food door, and rotatably support all of the ice mold 52, cooling plate 70, and drip tray 96.

In addition or alternatively, cold air can be ducted from another evaporator in the fresh food or freezer compartment, such as the system evaporator 27. The cold air can be ducted in various configurations, such as ducts that extend on or in the fresh food door, or possibly ducts that are positioned on or in the sidewalls of the fresh food liner or the ceiling of the fresh food liner. In one example, a cold air duct can extend across the ceiling of the fresh food compartment, and can have an end adjacent to the ice maker 20 (when the fresh food door is in the closed condition) that discharges cold air over and across the ice mold 52. If an ice bin is also located on the interior of the fresh food door, the cold air can flow downwards across the ice bin to maintain the ice pieces at a frozen state. The cold air can then be returned to the fresh food compartment, or alternatively can be ducted back to the freezer compartment. A similar ducting configuration can also be used where the cold air is transferred via ducts on or in the fresh food door. The cooling plate 70 can be beneficial to act as a cold heat sink that is chilled by the ducted cold air to maintain the ice mold 52 at a below freezing temperature. The ice mold 52 can be rotated to an inverted state for ice harvesting, as described herein, and a heater 90 can be similarly can be used. It is further contemplated that such a rotating ice making system could utilize an ice maker evaporator 54, either with or without cold air ducting. It is further contemplated that although an ice maker evaporator as described herein may not be used, a thermoelectric chiller or other alternative chilling device could be used in its place. In yet another alternative, a heat pipe or other thermal transfer body can be used in place of the ice maker evaporator, which can be chilled by the ducted cold air to facilitate and/or accelerate ice formation in the ice mold 52. Of course, it is contemplated that the rotating ice maker 20 of the instant application could similarly be adapted for mounting and use on a freezer door or drawer.

This application has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. An ice maker for a refrigeration appliance, the ice maker comprising:

an ice mold comprising a plurality of cavities for freezing water into ice pieces;

a frame extending from a first end of the ice mold to a second end of the ice mold, the frame rotatably supporting the ice mold within said refrigeration appliance between an ice-forming position and an ice-harvesting position; and a refrigeration system comprising an ice maker evaporator disposed adjacent the ice mold for cooling the ice mold to a temperature below zero degrees Centigrade, the refrigeration system including a valve for selectively diverting a refrigerant away from the ice maker evaporator, wherein the frame supports the ice maker evaporator at a stationary position that serves as a pivot axis for the first end of the ice mold so that the ice mold can rotate around the ice maker evaporator between the ice-forming position and the ice-harvesting position, while the ice maker evaporator remains stationary, and wherein the ice maker evaporator is in direct contact with the ice mold.

2. The ice maker of claim 1, wherein a rotational axis of the ice mold is co-axial with a longitudinal axis of the ice maker evaporator.

3. The ice maker of claim 1, further comprising a cooling plate coupled to an underside of the ice mold and extending between the first and second ends of the ice mold, wherein the ice maker evaporator is captured between the cooling plate and the ice mold.

4. The ice maker of claim 3, further comprising a rotational support interposed between the ice maker evaporator and an interior of the cooling plate, wherein the rotational support is one of a bearing and a bushing.

5. The ice maker of claim 3, wherein a first end of the cooling plate and the first end of the ice mold, when assembled together, form a pivot pin that is rotatably supported by a through hole of the frame to rotatably support the ice mold.

6. The ice maker of claim 5, wherein the ice maker evaporator extends through an interior passage of the pivot pin.

7. The ice maker of claim 5, wherein a second end of the cooling plate is supported by a motor that provides motive force to rotate both of the cooling plate and ice mold between the ice-forming position and the ice-harvesting position.

8. The ice maker of claim 3, further comprising a heater that is operable to provide a heating effect to the ice mold to thereby separate congealed ice pieces from the ice mold during an ice harvesting operation, wherein the heater is captured between the cooling plate and the ice mold.

9. The ice maker of claim 8, further comprising a drip tray located underneath the cooling plate and rotatable together therewith, the drip tray extending between first and second ends of the cooling plate to collect water droplets created when the heater is operated, wherein the drip tray has an angled surface, relative to the pivot axis of the ice mold, that directs said collected water droplets in a direction downwards towards a drain tube.

10. The ice maker of claim 1, wherein the direct contact between the ice maker evaporator and the ice mold includes the ice maker evaporator abutting the ice mold or the ice maker evaporator in contact with the ice mold via an intermediary.

11. An ice maker for a refrigeration appliance, the ice maker comprising:

an ice mold comprising a plurality of cavities for freezing water into ice pieces, wherein the ice mold is rotatably supported within said refrigeration appliance between an ice-forming position and an ice-harvesting position;

a refrigeration system comprising an ice maker evaporator in contact with the ice mold for cooling the ice mold to a temperature below zero degrees Centigrade, the refrigeration system including a valve for selectively diverting a refrigerant away from the ice maker evaporator;

a heater rotatable with the ice mold and operable to provide a heating effect to the ice mold to thereby separate congealed ice pieces from the ice mold during an ice harvesting operation; and a cooling plate coupled to an underside of the ice mold and extending between a first end and a second end of the ice mold, wherein the heater is captured between the cooling plate and the ice mold.

12. The ice maker of claim 11, further comprising:

a drip tray located underneath the ice mold and rotatable with the ice mold, the drip tray extending between a first end and a second end of the ice mold to collect water droplets created when the heater is operated, wherein the drip tray has a downwardly angled surface, relative to a normal operative position of the ice mold, that directs said collected water droplets towards a drain tube, wherein the downwardly angled surface of the drip tray is open at one end to discharge said collected water droplets towards the drain tube.

13. The ice maker of claim 11, wherein the ice maker evaporator is captured between the cooling plate and the ice mold, and wherein the ice maker evaporator forms a pivot axis for the first end of the ice mold so that the ice mold can rotate around the ice maker evaporator between the ice-forming position and the ice-harvesting position, while the ice maker evaporator remains stationary.

14. The ice maker of claim 13, wherein a rotational support is interposed the ice maker evaporator and an interior of the cooling plate, wherein the rotational support is one of a bearing and a bushing.

15. The ice maker of claim 11, further comprising:

a drip tray located underneath the ice mold and rotatable with the ice mold, the drip tray extending between a first end and a second end of the ice mold to collect water droplets created when the heater is operated, a frame extending from the first end of the ice mold to the second end of the ice mold, the frame rotatably supporting all of the ice mold, the cooling plate, and the drip tray within a compartment of the refrigeration appliance.

16. The ice maker of claim 15, wherein a first end of the cooling plate and the first end of the ice mold, when assembled together, form a pivot pin that is rotatably supported by a through hole of the frame to rotatably support all of the cooling plate, the ice mold, and the drip tray, wherein the ice maker evaporator extends through an interior passage of the pivot pin.

17. The ice maker of claim 16, wherein a second end of the cooling plate is supported by a motor that provides motive force to rotate all of the cooling plate, the ice mold, and the drip tray between the ice-forming position and the ice-harvesting position.

18. An ice maker for a refrigeration appliance, the ice maker comprising:

an ice mold comprising a plurality of cavities for freezing water into ice pieces;

a cooling plate coupled to an underside of the ice mold and extending between first and second ends of the ice mold;

a refrigeration system comprising an ice maker evaporator disposed adjacent the ice mold for cooling the ice mold to a temperature below zero degrees Centigrade, the refrigeration system including a valve for selectively diverting a refrigerant away from the ice maker evaporator, wherein the ice maker evaporator is captured between the cooling plate and the ice mold, and wherein the ice maker evaporator forms a pivot axis for the first end of the ice mold so that the ice mold can rotate around the ice maker evaporator between an ice-forming position and an ice-harvesting position, while the ice maker evaporator remains stationary; and an air mover to promote air circulation around the ice mold and the cooling plate, wherein the air mover is adapted to drive airflow over the ice mold to achieve a cooling effect to the water sufficient for freezing the water into said ice pieces.

19. The ice maker of claim 18, further comprising:

a drip tray located underneath the cooling plate and rotatable with the ice mold, the drip tray being spaced a gap distance apart from the cooling plate, wherein the air mover is further adapted to funnel a portion of said airflow through said gap distance between the drip tray and the cooling plate to further enhance a cooling effect to the cooling plate.

* * * * *